US008183448B2

(12) United States Patent
Mueller-Zierach et al.

(10) Patent No.: US 8,183,448 B2
(45) Date of Patent: May 22, 2012

(54) MUSICAL STRING

(75) Inventors: Eva Mueller-Zierach, Heusenstamm (DE); Volker Mueller-Zierach, Heusenstamm (DE)

(73) Assignee: Gustav Pirazzi & Comp. KG, Offenbach (DE)

( * ) Notice: Subject to any disclaimer, the term of this patent is extended or adjusted under 35 U.S.C. 154(b) by 0 days.

(21) Appl. No.: 12/514,368

(22) PCT Filed: Oct. 11, 2007

(86) PCT No.: PCT/EP2007/008846

§ 371 (c)(1),
(2), (4) Date: May 11, 2009

(87) PCT Pub. No.: WO2008/055574

PCT Pub. Date: May 15, 2008

(65) Prior Publication Data

US 2010/0071530 A1 Mar. 25, 2010

(30) Foreign Application Priority Data

Nov. 10, 2006 (DE) ..... 10 2006 053 406

(51) Int. Cl.
*G10D 3/00* (2006.01)

(52) U.S. Cl. ..... 84/297 S; 84/297 R

(58) Field of Classification Search ..... 84/297 S, 84/297 R, 290

See application file for complete search history.

(56) References Cited

U.S. PATENT DOCUMENTS

| | | | | |
|---|---|---|---|---|
| 2,049,769 | A * | 8/1936 | Gray | 84/199 |
| 2,710,557 | A | 6/1955 | Sundt | |
| 4,654,263 | A * | 3/1987 | Cox | 428/366 |
| 5,427,008 | A | 6/1995 | Ueba et al. | |
| 5,587,541 | A | 12/1996 | McIntosh et al. | |
| 5,601,762 | A | 2/1997 | Ferrari et al. | |
| 6,503,623 | B1 | 1/2003 | Oue et al. | |
| 6,835,454 | B1 * | 12/2004 | Randa et al. | 428/373 |
| 2002/0035912 | A1 * | 3/2002 | Barney | 84/297 S |
| 2006/0128933 | A1 * | 6/2006 | Morita et al. | 528/220 |
| 2007/0084329 | A1 * | 4/2007 | Allen et al. | 84/452 R |
| 2007/0270068 | A1 * | 11/2007 | Luo et al. | 442/337 |
| 2010/0071529 | A1 * | 3/2010 | Infeld | 84/297 S |

FOREIGN PATENT DOCUMENTS

| | | |
|---|---|---|
| AT | 501070 | 6/2006 |
| CH | 213923 | 3/1941 |
| DE | 3701503 | 8/1987 |
| DE | 19754606 | 6/1998 |
| DE | 20108716 | 10/2001 |
| EP | 1081270 | 3/2001 |
| EP | 1531454 | 5/2005 |

OTHER PUBLICATIONS

International Search Report for International No. PCT/EP2007/008846 mailed on Jul. 14, 2008.

* cited by examiner

*Primary Examiner* — Kimberly Lockett
(74) *Attorney, Agent, or Firm* — Leydig, Voit & Mayer, Ltd.

(57) ABSTRACT

A string for musical instruments comprises a core including a gut material and a coating covering the core. The coating includes a material of a polyaryletherketon (PAEK) material class.

10 Claims, 3 Drawing Sheets

MUSICAL STRING

This is a U.S. National Phase Application under 35 U.S.C. §371 of International Application No. PCT/EP2007/008846, filed on Oct. 11, 2007, which claims priority to German Application No. DE 10 2006 053 406.9, filed on Nov. 10, 2006. The International Application was published in German on May 15, 2008 as WO 2008/055574 A2 under PCT 21 (2).

The invention relates to a string for musical instruments.

BACKGROUND

Strings for musical instruments are manufactured in a multitude of types, made of different materials and material compositions. The type of string is designed, in accordance with the specific application, for the tone range and the musical instrument in question. To fulfill the musical requirements, different materials can be used for the manufacture of a string. Musical strings of particularly high quality are made of gut.

Gut strings for musical instruments are usually made of the guts of hoofed animals, mostly of sheeps, and are used as a rule in plucked or bowed string instruments. However, the fact that the strings are stretched on the instrument under a certain tension and that they are hit, plucked or bowed when the instrument is played, results in high wear of the musical string. Therefore, nowadays, gut strings are usually manufactured in the form of so-called gut core strings, in which an inner, carrying area of the string, also called the core, consisting of gut, is provided with an external spinning made of poly plastic, such as nylon, or metal, such as aluminum and titanium. The external spinning can in particular be provided for giving the string sufficient mass, in order to generate also relatively deep tones.

In general, such strings based on gut possess good tonal properties. However, in the course of time, such strings show relatively great changes in tone, due to their water-absorbing capacity. Consequently, the string has to be re-tuned relatively frequently. Strings with a nylon-based coating have, furthermore, the disadvantage that the water-absorbing capacity of nylon (absorption of humidity of nylon: ~3-4%) is also very high and, in addition, the expansion properties of nylon are poor.

The re-tensioning of the musical strings, in particular for tuning the musical instruments by tensioning the string, and the degree of wear through the bowing of the string may lead to the formation of fissures inside the string and possibly even to a rupture of the entire string. In addition, there are aging phenomena of the string material used. Therefore, for intensely used orchestra instruments, it may be necessary relatively frequently to exchange a string, to prevent a deterioration of the specific musical characteristics of the instrument, in particular the quality of tone and sound. In view of the possibly long playing-in times of the strings, it is, however, desirable to reduce the frequency of string exchanges.

SUMMARY OF THE INVENTION

Therefore, an aspect of the invention is to provide a musical string of the above-mentioned type, which possesses a relatively long expectancy of service life, in particular with good sound quality.

The present invention provides a string comprising a core and a coating covering it, made of a material of the polyaryletherketon (PAEK) material class.

The invention is based on the consideration that in view of the usually high stress of the strings, special measures should be taken to stabilize the strings, for a particularly long service life of the strings. For this purpose, it is provided, in order to strengthen the strings, to provide the core with a coating made of a specifically selected material. Such a material should, on the one hand, through its special molecular arrangement, be highly extensible and extremely stressable and possess a high tensile strength, but, on the other hand, still elastic in view of the requirements imposed on the string. Surprisingly, it has turned out that these material properties and technical-physical characteristics can be achieved to a particularly high degree with a material of the polyaryletherketon (PAEK) material class.

Polyetheretherketon, abbreviated PEEK, has turned out to be a particularly well suited material from the polyaryletherketon (PAEK) material class. The technical-physical characteristics of polyetheretherketon (PEEK) are very similar to those of gut, and, furthermore, PEEK possesses the musical and tonal properties required for a musical string. Both materials, polyetheretherketon (PEEK) as well as gut, have a density in the range of $\rho=1.27$ to $1.32\ g/cm^3$. Due to these comparable properties, a particularly homogeneous sound pattern and a high compatibility are reached especially with a pairing of the materials polyetheretherketon (PEEK) and gut. In addition, contrary to other coating materials made of polymer plastics, polyetheretherketon (PEEK), having an absorption of humidity of only 0.1%, is far less sensitive to humidity. In other words, polyetheretherketon (PEEK) possesses a good water resistence. Especially when using PEEK in the coating for the core, the latter can also be protected to a certain extent against humidity, which is even more favorable for the durability of the string as a whole. Furthermore, a musical string coated with polyetheretherketon (PEEK) shows a higher tuning stability and, surprisingly, also a shorter playing-in time.

In particular in view of the intended application, it will be expedient if the coating material is adapted, through a suitable selection of the parameters, for example with regard to the dimensioning, to the specific musical, tonal or sound-technical requirements, as well as to the elongation resistence and the tensile strength to be fulfilled by the string. In this way, in particular a good musical tone, a simple handling while playing and, in addition, a particularly long service life can be achieved. For this purpose, the coating material is expediently manufactured as a fiber. This makes the handling of the coating material in the manufacturing process of the musical string relatively simple, and, in addition, the future total diameter, the mass and possibly also the pitch level of the string can be influenced by a suitable dimensioning of the fiber.

The fineness of fibers and yarns is a textile quantity indicated in the unit tex. The unit tex is expressed in SI units with the conversion factor of 1 tex=1 g/1000 m, so that the fineness of the fiber expresses a weight per length of the fiber to be manufactured. In other words, the unit tex describes a length-related mass of a fiber or a yarn. Advantageously, the fiber of the coating material has, for the above-mentioned reasons, a fineness, depending on the musical application, in a range of 20 dtex to 280 dtex. This range covers the intended musical application in view of the different pitch levels of the musical string and the application of the string with regard to its dimensioning in different instruments in a particularly favorable manner.

Furthermore, it is expedient to construct such a fiber with a number of 5 to 80 very fine threads per fiber. By selecting the number of threads from the above-mentioned range, a good adjustment of the fineness of the fiber is already given during the manufacturing process. Furthermore, the future tensile and elongation strength of the fiber can be adjusted by means of the type of twist of the threads in relation to the fiber. In this way, the fiber can be manufactured, as to its dimensioning, with the exact desired total diameter of the future finished musical string.

The coating of the core can be executed as a so-called spinning, in which the coating material is helically led, in the form of one or more helical ropes, around or along the core.

To further increase stability and durability of the musical string, the coating is, however, advantageously executed as a braiding, i.e. the coating material is led around the core in several ropes crossing each other. Such a braided structure also increases the tear strength of the musical string and reduces the formation of fissures. Furthermore, the coating executed as a braiding protects the core of the string in particular against excessive absorption of humidity, because it can be executed in a relatively dense manner. As such a braiding can cover the core of the string in one or more layers, it has also an influence on the dimensioning of the string.

As material of the core, common materials, such as metals or plastics, e.g. nylon, can generally be provided. Especially in view of the particularly good compatibility of the materials gut and polyetheretherketon (PEEK), however, gut is provided as the basic material of the core in a particularly advantageous embodiment. The value of the gut-core string is particularly increased especially through the coating and can, therefore, also be used for particularly high-quality applications, such as the stringing of plucked and bowed string instruments and even baroque instruments. Surprisingly, it has turned out that especially a string with such a material pairing offers clear advantages as compared with known strings, as far as playability and tuning stability are concerned, and, furthermore, possesses a particularly short playing-in time.

Expediently, the diameter of the core lies in the range of 0.15 mm to 5 mm, to cover the common tone ranges of high-quality plucked and bowed string instruments with a particularly good sound.

In another advantageous embodiment, the coating is additionally provided with an outer spinning, preferably made of plastic or metal, which covers the coating. For this purpose, a flat metal strip, wound firmly and helically around the coating, can be provided. Furthermore, such an outer spinning offers advantages in the processing of the musical string through cyclindrical fine grinding. The cylindrical precision-grinding may be necessary to obtain the truth in the fifth of the musical string. Furthermore, the outer spinning protects the string against premature fraying.

Advantageously, it is provided to use at least one string comprising a gut core and a coating made of polyetheretherketon (PEEK) in musical instruments belonging to the family of bowed or plucked string instruments.

The advantages achieved with the invention consist in particular in that the gut-core string coated with polyetheretherketon (PEEK) fiber possesses a particularly long service life and, at the same time, a good sound quality. Thus, it is possible to make use in a particularly favorable way of the favorable properties of polyetheretherketon (PEEK), in particular of the relatively high humidity resistence and the density range of the material, which is comparable to that of gut. In addition, the polyetheretherketon (PEEK) coating protects the gut core against excessive absorption of humidity. Furthermore, it has turned out that the so-called playing-in time of the string can clearly be reduced.

BRIEF DESCRIPTION OF THE DRAWINGS

An exemplary embodiment of the invention is explained in detail by means of a drawing, in which.

Identical parts are marked with the same reference numbers in all figures.

DETAILED DESCRIPTION

Figure 1:
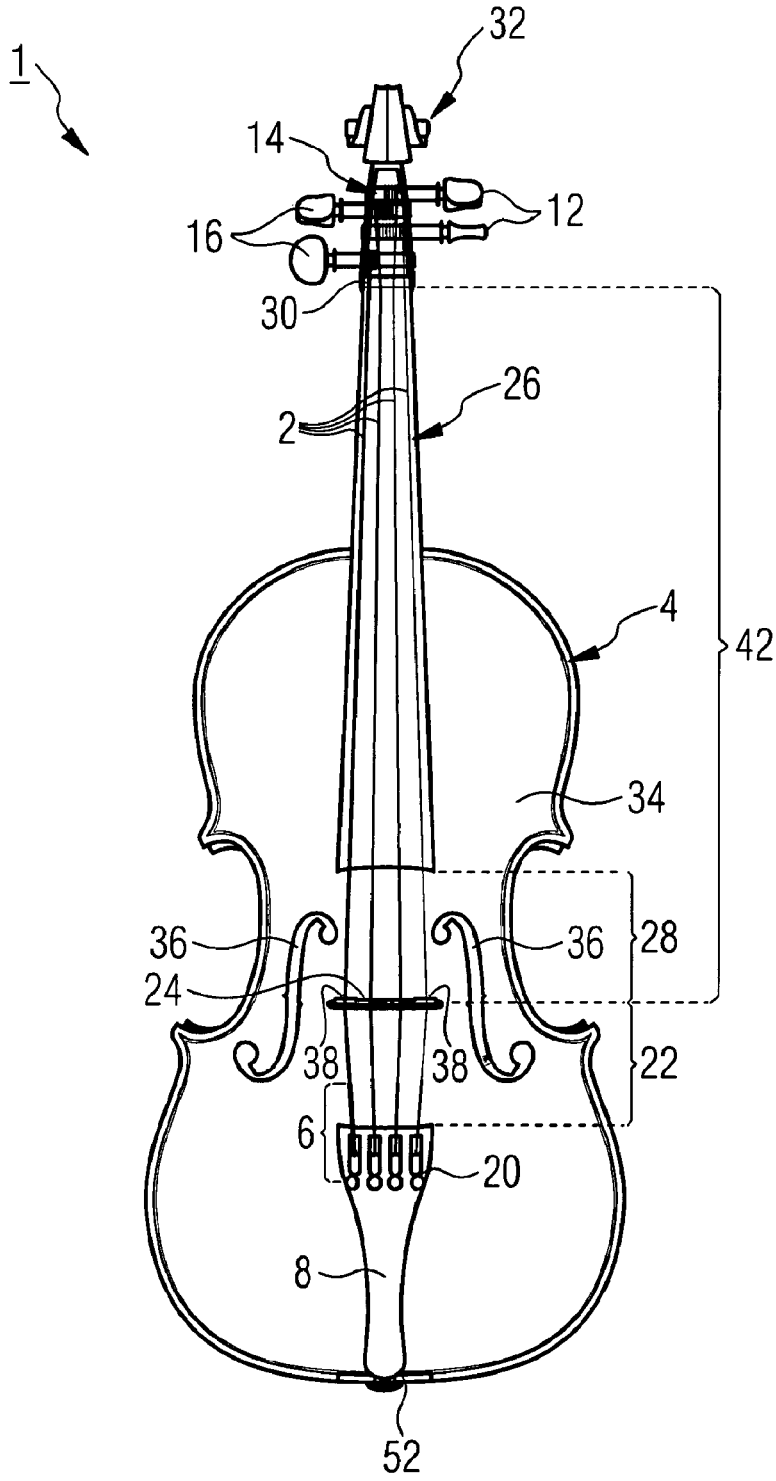
FIG. 1 is a schematic view of a classical violin.

A classical violin 1 according to FIG. 1 comprises four strings 2 stretched over a resonance body 4. At a first end, the tailpiece end 6, the strings 2 are fastened on a tailpiece 8, whereas at their second end, the tuning-peg end 10, they are fastened on tuning pegs 12 of a tuning mechanics, the so-called pegbox 14. For this purpose, the tuning pegs 12 include a hole through which the tuning-peg end 10 of the string 2 is passed. The area adjacent to the tuning-peg end 10 is wound several times around the peg 12. The pegs 12 can be turned by means of their peg handle plates 16, whereby the tension of the string and thus the tone of the string 2 can be changed.

On the tailpiece end 6, the string 2 is provided with an end head 18, which is fastened in the tailpiece 8. Furthermore, an adjuster 20 is fastened on the tailpiece 8, with the help of which the tension of each string 2 is precision-adjusted. The adjuster 20 helps the musician in tuning the tone of the string 2 even more precisely than this is possible by means of the tuning pegs 12.

A mounting section 22 of the string 2 is situated between the tailpiece 8 and a bridge 24 and is partially spun over, from the end head 18 in the area of the tailpiece end 6, with colored yarn. The colored yarn serves for indicating the quality of the string. The tuning-peg end 10 of the string 2, which is wound around the peg 12, is also spun over with colored yarn, which informs the musician of the exact tone range of the string.

The area between the bridge 24 and a fingerboard 26 is the playing area 28, in which the musician plucks or bows the strings 2. For playing the violin 1, the musician plays the tones on the strings 2 along the fingerboard 26 and bows the strings 2 in the playing area 28.

On the other end of the fingerboard 26, an upper nut 30 is provided, over which the strings 2 are led to the tuning pegs 12 in the pegbox 14. The end piece of the pegbox 14, and thus also of the violin 1, is formed by a scroll 32.

In a soundboard 34 of the resonance body 4, the two f-holes 36 of the violin 1 are formed laterally at the level of the bridge 24. The f-holes 36 serve for unhampered movement of the air contained in the resonance body, and, furthermore, the vibration capacity of the soundboard 34 in the acoustic center around the bridge feet 38 is considerably increased.

Figure 2:
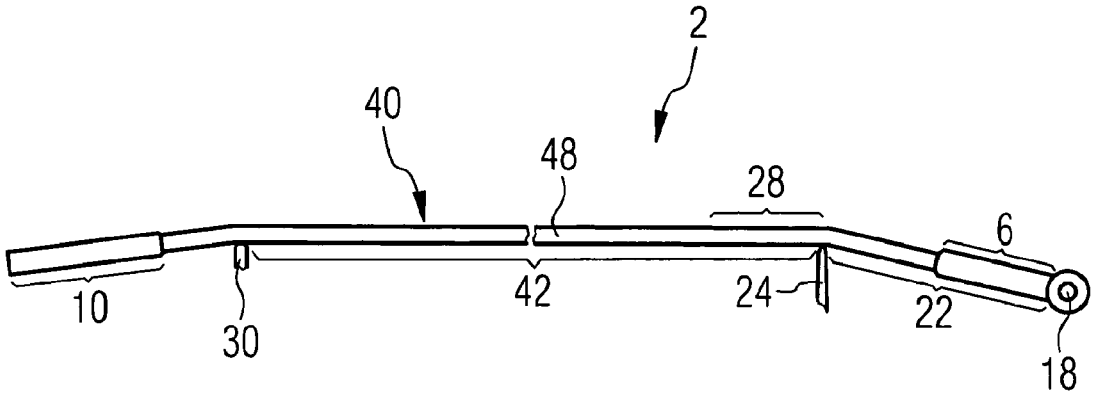
FIG. 2 shows a musical string for a violin with the bridge, the upper nut and a tuning peg being indicated.

The outer structure of the string 2 is explained in detail by means of FIG. 2. This figure shows the end button 18 with the mounting section 22, partially spun over with colored yarn and forming the tailpiece end 6, and the string body 40, which is in most cases polished, with the adjacent tuning-peg end 10 of the string, which is also spun over with colored yarn. In a perspective view, the bridge 24 and the upper nut 30 are indicated. The string body 40, in most cases polished, is a sound-generating section 42, forming the playing area 28 and the area of the string 2 above the fingerboard 26 up to the upper nut 30.

Figure 3:
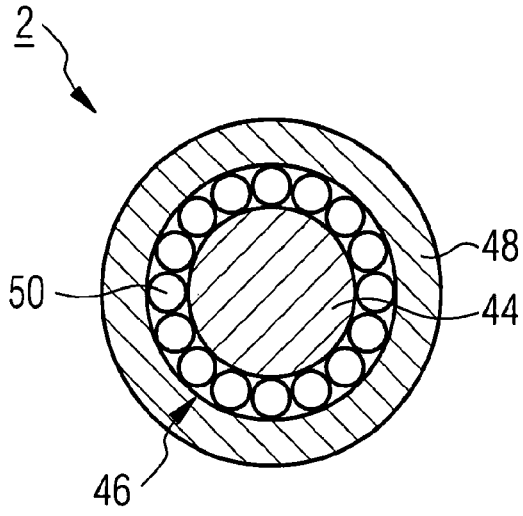
FIG. 3 is a cross-section of the musical string shown in FIG. 2.

The cross-sectional representation of FIG. 3 shows the inner structure of the string 2. The string 2 is executed with a core 44, a coating 46 and an outer spinning 48. The coating 46 made of polyetheretherketon (PEEK) fiber is executed as a braiding. The outer spinning 48 consists of a flat metal strip, which is spun firmly and helically around the coating 46 and is in most cases ground, depending on the application.

The core 44 of the string 2 consists of gut which, after having been processed into the core 44, shows a kind of monofil structure.

The coating 46 of the string 2 is made of polyetheretherketon (PEEK) fiber 50, the fiber 50 consisting of individual threads with a thread number of 5 to 80 and having a fineness in the range of 20 dtex to 280 dtex. Furthermore, the fibers 50 are interlaced to form a braided structure, the so-called braiding, in order to give the coating 46 a higher stressability and tear strength. In additon, such a braided structure prevents a premature fraying of the string 2 as well as a premature formation of fissures within the coating 46.

Furthermore, the string 2, consisting of the core 44, the outer spinning 48 and the coating 46, which includes a braiding made of polyetheretherketon (PEEK) fiber, has a longer service life. Furthermore, due to its good elongation resistence and tensile strength, such a string 2 is better to play and simple to handle.

The violin 1 is designed, among others, for a particularly long service life and a high musical quality of the string 2 used. For this purpose, some or all strings 2 are manufactured from a gut core and a coating of polyetheretherketon (PEEK) fiber, which, through a suitable selection of the parameters, for example composition and thread thickness, is adapted to the specific requirements of the string 2 in question.

The tailpiece 8 is fastened at its end area 52 via a so-called tailgut under prestress on a holding button. For this tailgut, too, polyetheretherketon (PEEK) can be provided as the coating material.

Figure 4:
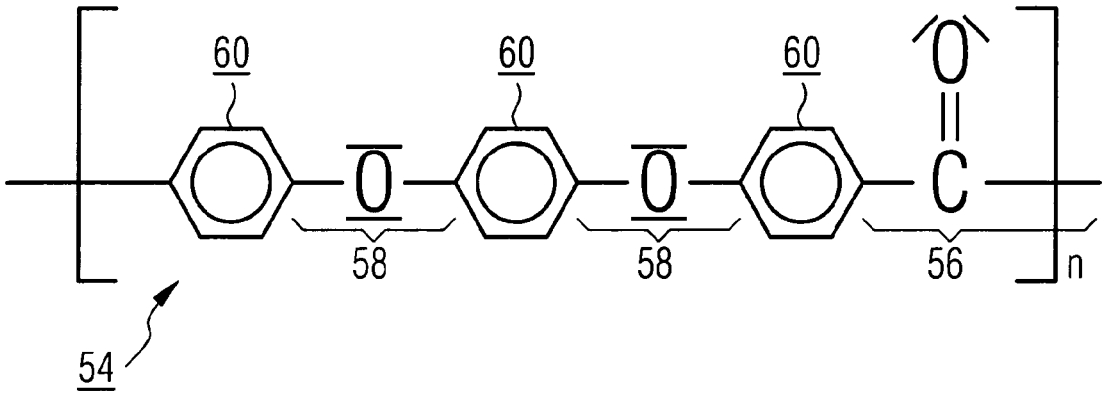
FIG. 4 shows the chemical structure of a polyetheretherketon monomer unit.

The chemical structure of a polyetheretherketon (PEEK) monomer unit 58 is shown in FIG. 4. The polyetheretherketon (PEEK) polymer has a long-chain structure made of a repetitive number n of monomer units 54. The monomer unit 54 is made up of phenyl rests 60 linked through keto bridges 56 and ether bridges 58. Each monomer unit 58 contains one keto bridge 56, two ether bridges 58, and three phenyl rests 60. The monomer units 54 are polymerized in the polyetheretherketon (PEEK) polymer exclusively through the keto bridge 56 of one monomer unit 54 with a phenyl rest 60 of another monomer unit 54. The material purity of the polyetheretherketon (PEEK) polymer is subject to the known chemico-technical purity requirements of polymer manufacture.

FIGS. 1 to 3 represent the gut-core string with polyetheretherketon (PEEK) fiber coating and outer metal spinning as a musical string by means of the example of a string 2 in the violin 1. Of course, the invention also covers the use of such a gut-core string with polyetheretherketon (PEEK) fiber coating in any other string instrument, in particular bowed and plucked string instruments, as well as the execution of the core 44 as a multifilament structure and with other core materials.

| List of reference numbers | |
|---|---|
| 1 | Violin |
| 2 | String |
| 4 | Resonance body |
| 6 | Tailpiece end |
| 8 | Tailpiece |
| 10 | Tuning-peg end |
| 12 | Tuning peg |

-continued

| List of reference numbers | |
|---|---|
| 14 | Pegbox |
| 16 | Peg handle plate |
| 18 | End head |
| 20 | Adjuster |
| 22 | Mounting section |
| 24 | Bridge |
| 26 | Fingerboard |
| 28 | Playing area |
| 30 | Upper nut |
| 32 | Scroll |
| 34 | Soundboard |
| 36 | f-hole |
| 38 | Bridge feet |
| 40 | String body |
| 42 | Sound-generating section |
| 44 | Core |
| 46 | Coating |
| 48 | Outer spinning |
| 50 | Fiber |
| 52 | End area |
| 54 | Monomer unit |
| 56 | Keto bridge |
| 58 | Ether bridge |
| 60 | Phenyl rest |
| n | Number of monomer units in the polymer |

The invention claimed is:

1. A string for musical instruments comprising:

a core including a gut material; and a coating covering the core, the coating including a material of a polyaryletherketon (PAEK) material class and including a fiber having a fineness of at least 20 dtex and no more than 280 dtex, wherein the fiber includes at least 5 threads and no more than 80 threads.

2. The string as recited in claim 1, wherein the material of the polyaryletherketon (PAEK) material class includes polyetheretherketon.

3. The string as recited in claim 1, wherein the coating has a braided structure.

4. The string as recited in claim 1, wherein the core has a diameter of at least 0.15 mm and no greater than 5 mm.

5. A musical instrument comprising:

a resonance body;

at least one string stretched over the resonance body, wherein the at least one string includes a core having a gut material and a coating covering the core, the coating having a material of a polyaryletherketon (PAEK) material class and including a fiber having a fineness of at least 20 dtex and no more than 280 dtex, wherein the fiber includes at least 5 threads and no more than 80 threads.

6. The musical instrument as recited in claim 5, wherein the material of the polyaryletherketon (PAEK) material class includes polyetheretherketon.

7. The musical instrument as recited in claim 5, wherein the coating has a braided structure.

8. The musical instrument as recited in claim 5, wherein the core has a diameter of at least 0.15 mm and no greater than 5 mm.

9. The musical instrument as recited in claim 5, wherein the at least one string includes an outer spinning covering the coating.

10. The musical instrument as recited in claim 9, wherein the outer spinning includes metal.

* * * * *